US006126415A

United States Patent [19]

Lasko

[11] Patent Number: 6,126,415

[45] Date of Patent: Oct. 3, 2000

[54] COMBINATION FLOOR AND WINDOW BOX FAN

[75] Inventor: William E. Lasko, West Chester, Pa.

[73] Assignee: Lasko Holdings, Inc, West Chester, Pa.

[21] Appl. No.: 09/009,819

[22] Filed: Jan. 20, 1998

[51] Int. Cl.[7] ..... F04B 17/00

[52] U.S. Cl. ..... 417/423.15; 417/360; 417/234; 416/246; 416/247; 416/146; 454/200; 454/205

[58] Field of Search ..... 417/234, 423.15, 417/360; 415/213.1, 214.1, 121.2; 416/246, 247, 63, 146; 454/200, 205; 248/220.21, 223.41, 298.1; 403/375, 381

[56] References Cited

U.S. PATENT DOCUMENTS

| | | | |
|---|---|---|---|
| 2,390,588 | 12/1945 | Heckman | 417/423.15 |
| 2,677,522 | 5/1954 | Johnson | 248/236 |
| 2,857,095 | 10/1958 | Grau | 416/246 |
| 2,950,859 | 8/1960 | Kirk | 417/234 |
| 2,961,152 | 11/1960 | Douglas et al. | 417/234 |
| 4,341,151 | 7/1982 | Sakamoto | 417/234 |
| 5,368,262 | 11/1994 | Garrity | 248/131 |

*Primary Examiner*—Charles G. Freay
*Assistant Examiner*—Cheryl J. Tyler
*Attorney, Agent, or Firm*—Zachary T. Wobensmith, III

[57] ABSTRACT

A combination floor and window box fan which can be placed on a floor or other supporting surface, and also hung from a window, with brackets on the fan housing in the window opening, and retained therein by engaging a window sash and the window sill, which fan housing may be rotated between the brackets to pull air into, or exhaust air from a space, without modification to the window opening.

7 Claims, 9 Drawing Sheets

COMBINATION FLOOR AND WINDOW BOX FAN

BACKGROUND OF THE INVENTION

1. Field of the Invention

This invention relates to a combination floor and window box fan, which is adjustable for air direction, with a base that can sit on a supporting surface, and brackets on the sides with which the fan can be mounted in a window opening.

2. Description of the Prior Art

Box fans are probably the most widely produced fans available.

Box fans are of simple construction, are safe, inexpensive, easy to place and to relocate.

It is commonplace to use box fans on floors, and to place them in or adjacent to open windows to draw air into a space, or to exhaust air out an open window.

Many windows however are not suitable for placing box fans as the window openings are too small or the sills are too narrow.

Even with window sills and openings that are wide the fan often is placed such that it is susceptible of dislodgement, and therefore it must be placed straight ahead, which is disadvantageous if it is desired to direct the air flow. Placing the fan on a sill in an open window exposes the fan motor, wiring and blades to the elements, which is undesirable. Placement of the fan on an additional support such as a table or chair adjacent to the window, is often not feasible due to space and other limitations.

Various prior art patents are available, which are pertinent, such as U.S. Pat. No. 619,752 to Hudson; U.S. Pat. No. 866,463 to Hart; U.S. Pat. No. 1,324,713 to Adsit; U.S. Pat. No. 2,677,552 to Johnson; U.S. Pat. No. 2,857,095 to Suarez Gran; U.S. Pat. No. 5,050,831 to Joyal; U.S. Pat. No. 5,195,869 to Groenhoff; and U.S. Pat. No. 5,368,262 to Garrity. None of the prior art structures effectively functions as a combination floor and window box fan that can sit on a floor, or have brackets on its side engaged in a window opening locating the motor, fan blades and wiring inside the room to lessen the likelihood of exposure to the elements. The fan is rotatable to draw in or to exhaust air through an open window, without removing the fan from the window opening, and without alteration of the window frame.

SUMMARY OF THE INVENTION

It has now been found that a combination floor and window box fan is available, which box fan has a base attached to the fan by brackets that can rest on a supporting surface, or brackets on the sides engage a window sill and an open window sash, which fan is capable of pivoting within the brackets for air flow direction, whether on the floor or in front of a window opening.

The principal object of the invention is to provide an adjustable combination floor and window box fan.

A further object of the invention is to provide a box fan of the character aforesaid wherein the fan can be used to draw in or to exhaust air from a room.

A further object of the invention is to provide a fan of the character aforesaid which locates the fan motor, fan blades and wiring inside the room to lessen their exposure to the elements.

A further object of the invention is to provide a fan of the character aforesaid which is easy to use.

A further object of the invention is to provide a fan of the character aforesaid which can be used with a wide variety of windows.

A further object of the invention is to provide a fan of the character aforesaid which provides a large number of air flow directions.

A further object of the invention is to provide a fan of the character aforesaid that is sturdy and reliable in operation.

A further object of the invention is to provide a fan of the character aforesaid that is simple and inexpensive to construct.

Other objects and advantageous features of the invention will be apparent from the description and claims.

DESCRIPTION OF THE DRAWINGS

The nature and characteristic features of the invention will be more readily understood from the following description taken in connection with the accompanying drawings forming part hereof in which.

Figure 1:
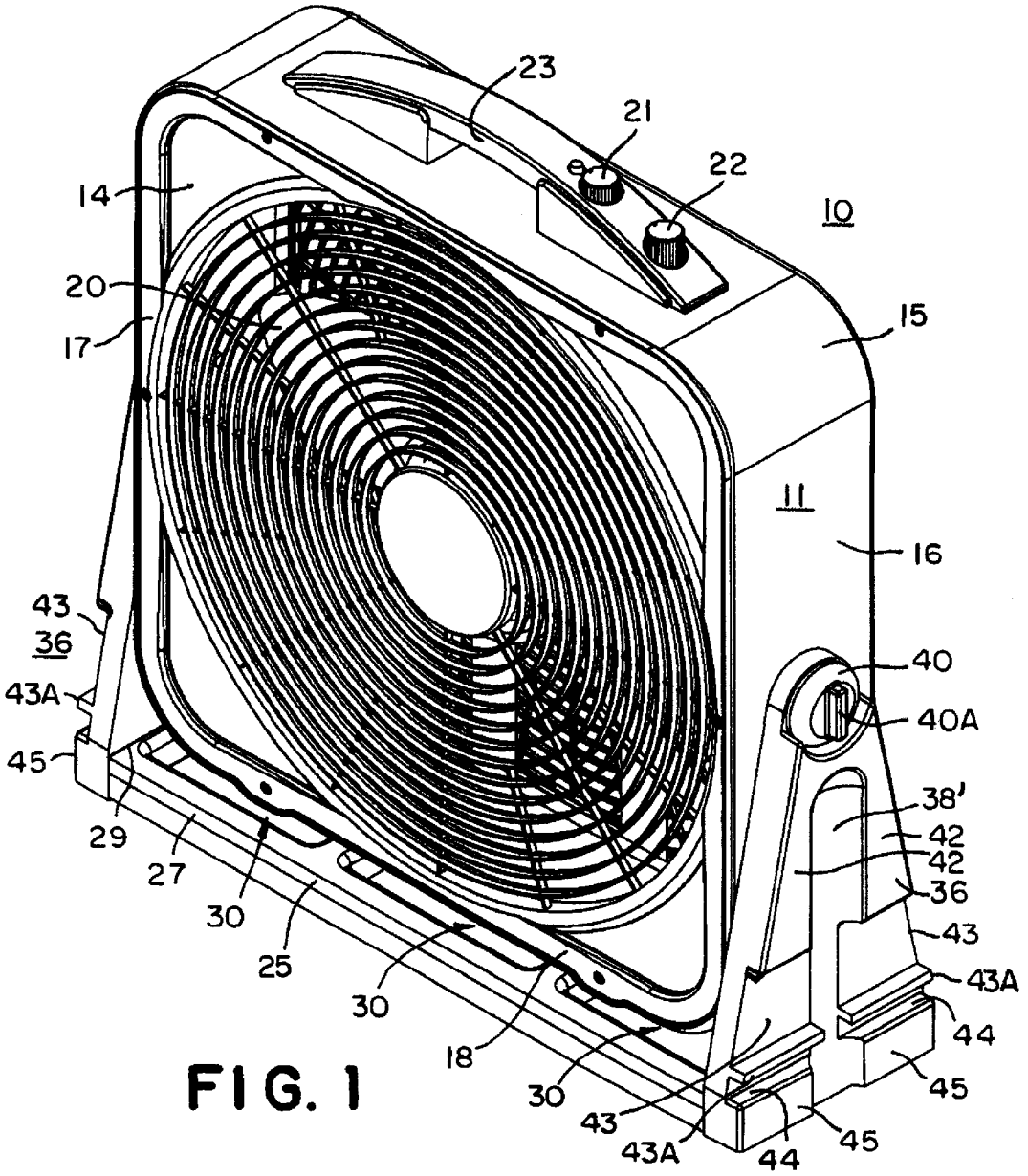
FIG. 1 is a perspective view of the combination floor and window box fan of the invention.
Figure 2:
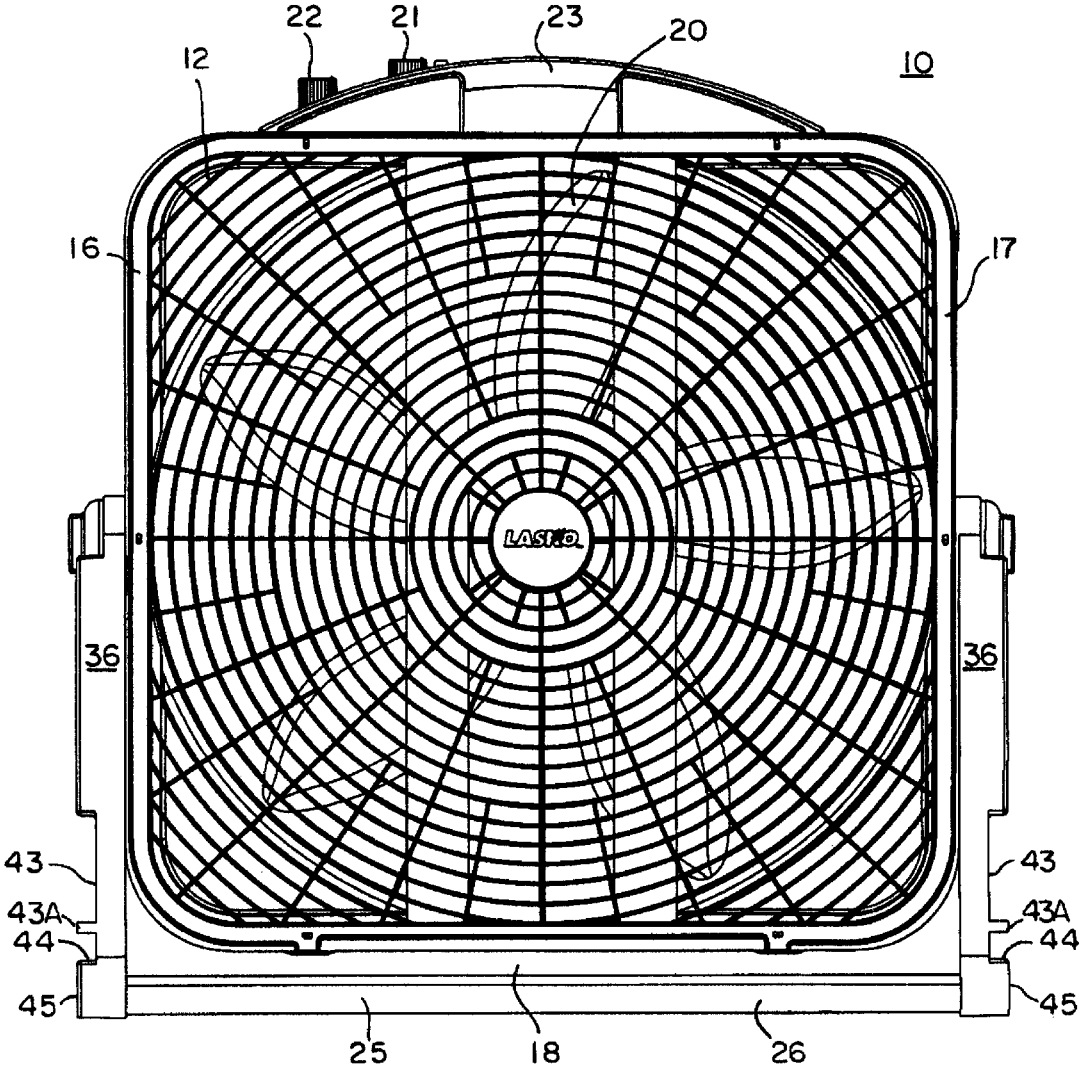
FIG. 2 is a front plan view of the fan of FIG. 1.
Figure 3:
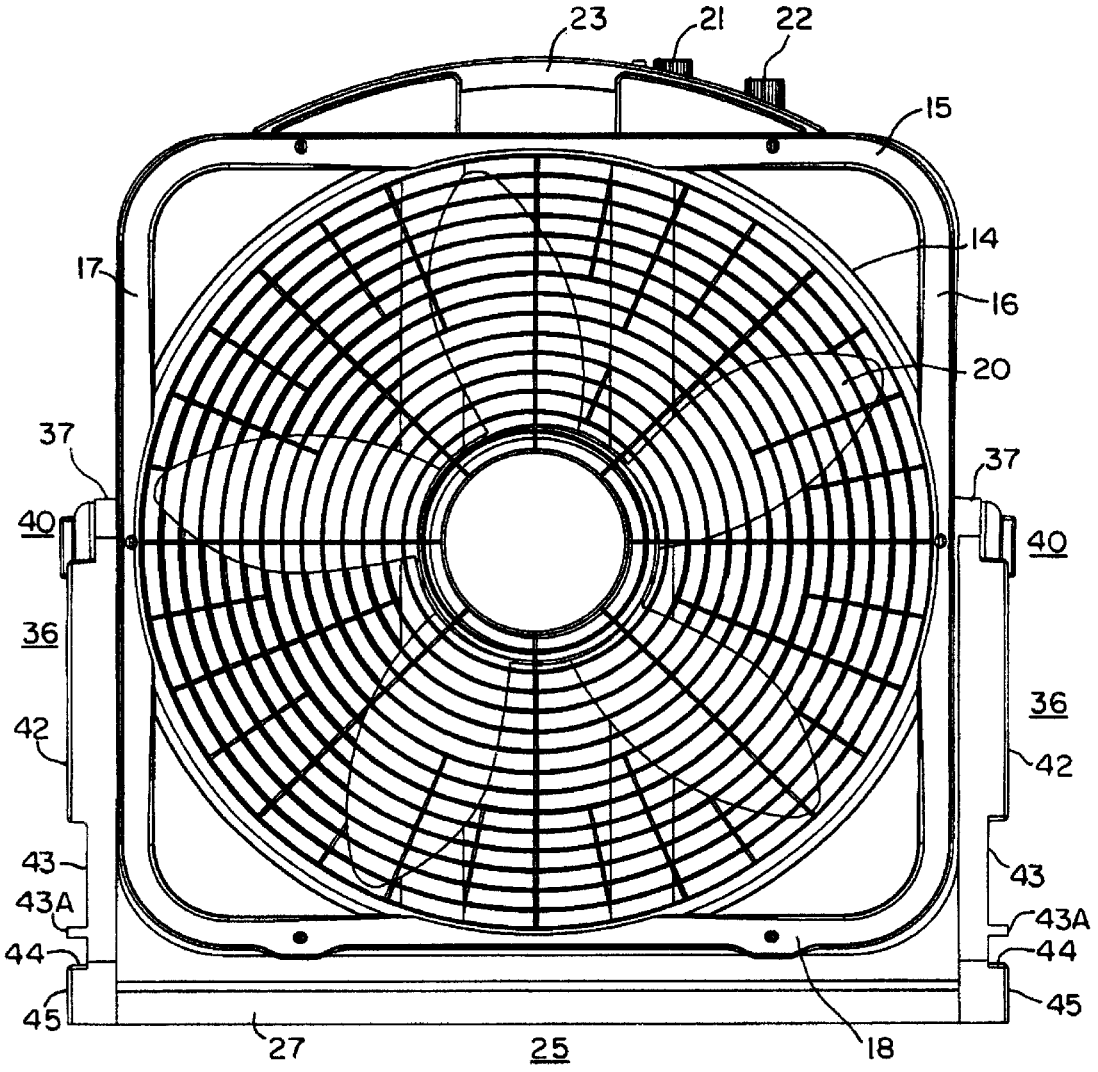
FIG. 3 is a rear plan view of the fan of FIG. 1.
Figure 4:
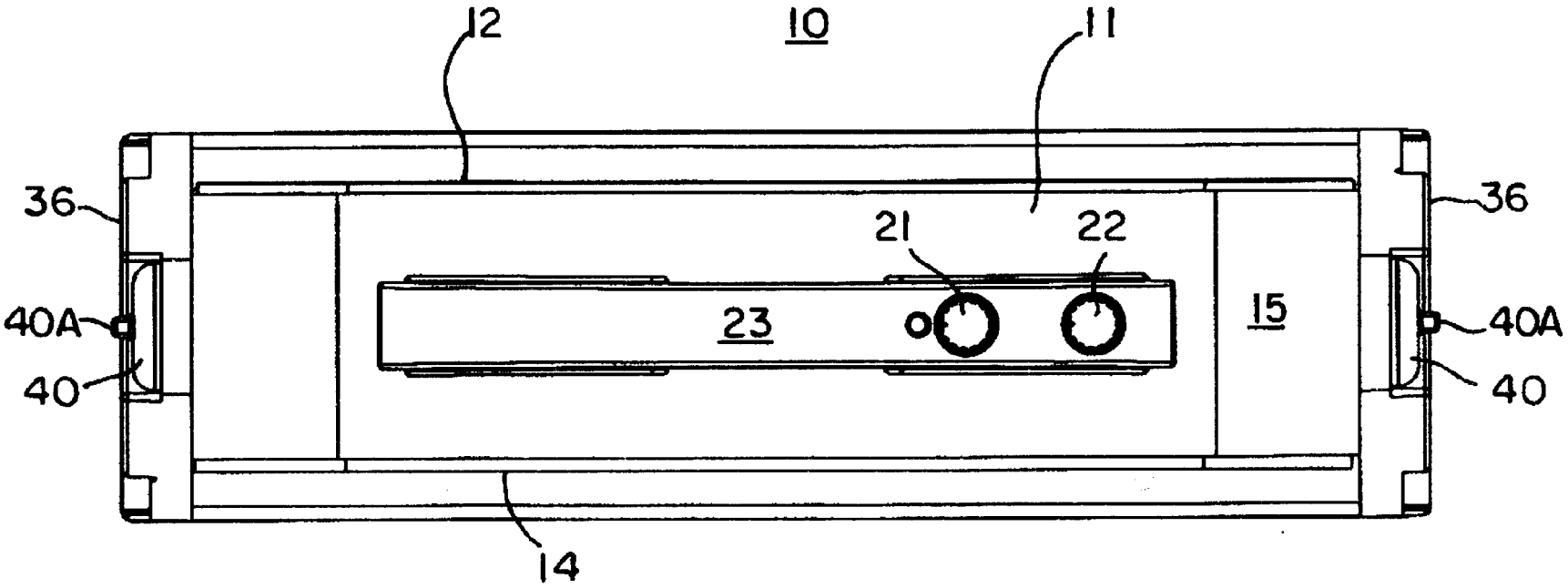
FIG. 4 is a top plan view of the fan of FIG. 1.
Figure 5:
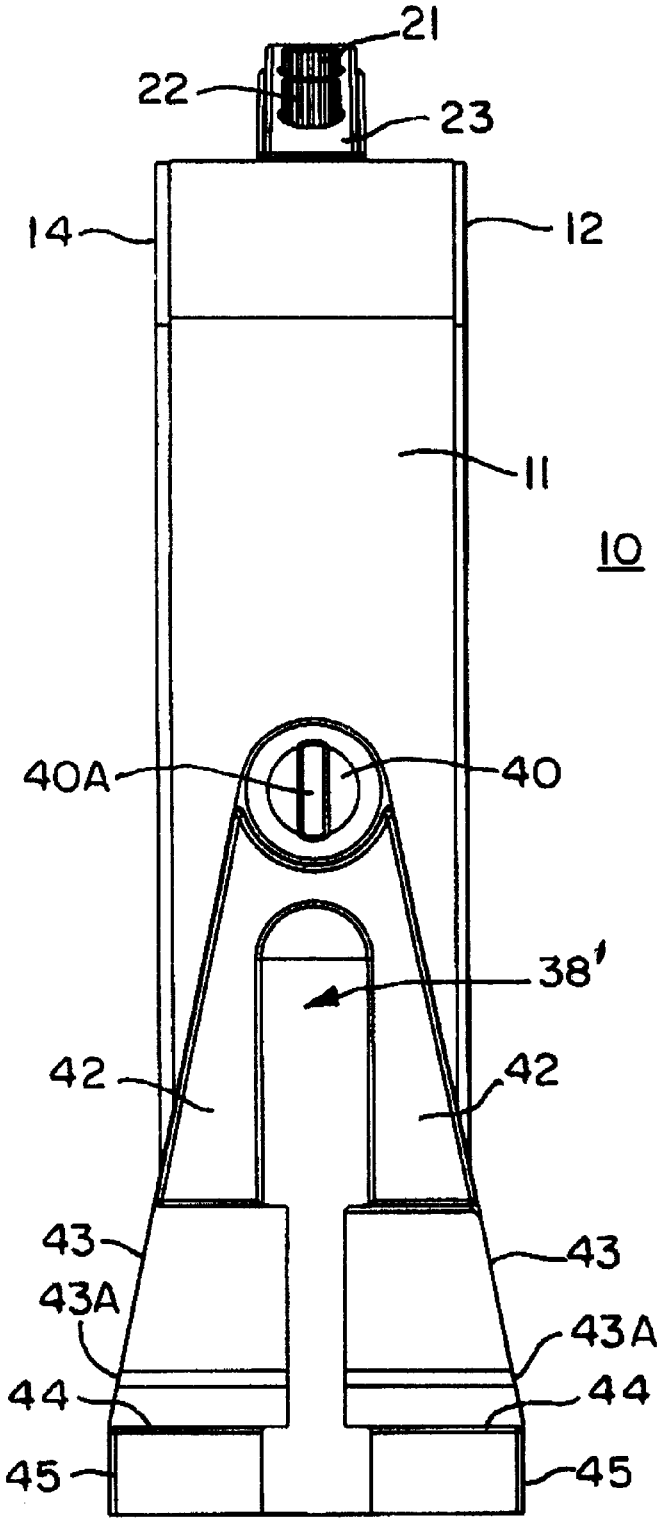
FIG. 5 is a right side elevational view of the fan of FIG. 1.
Figure 6:
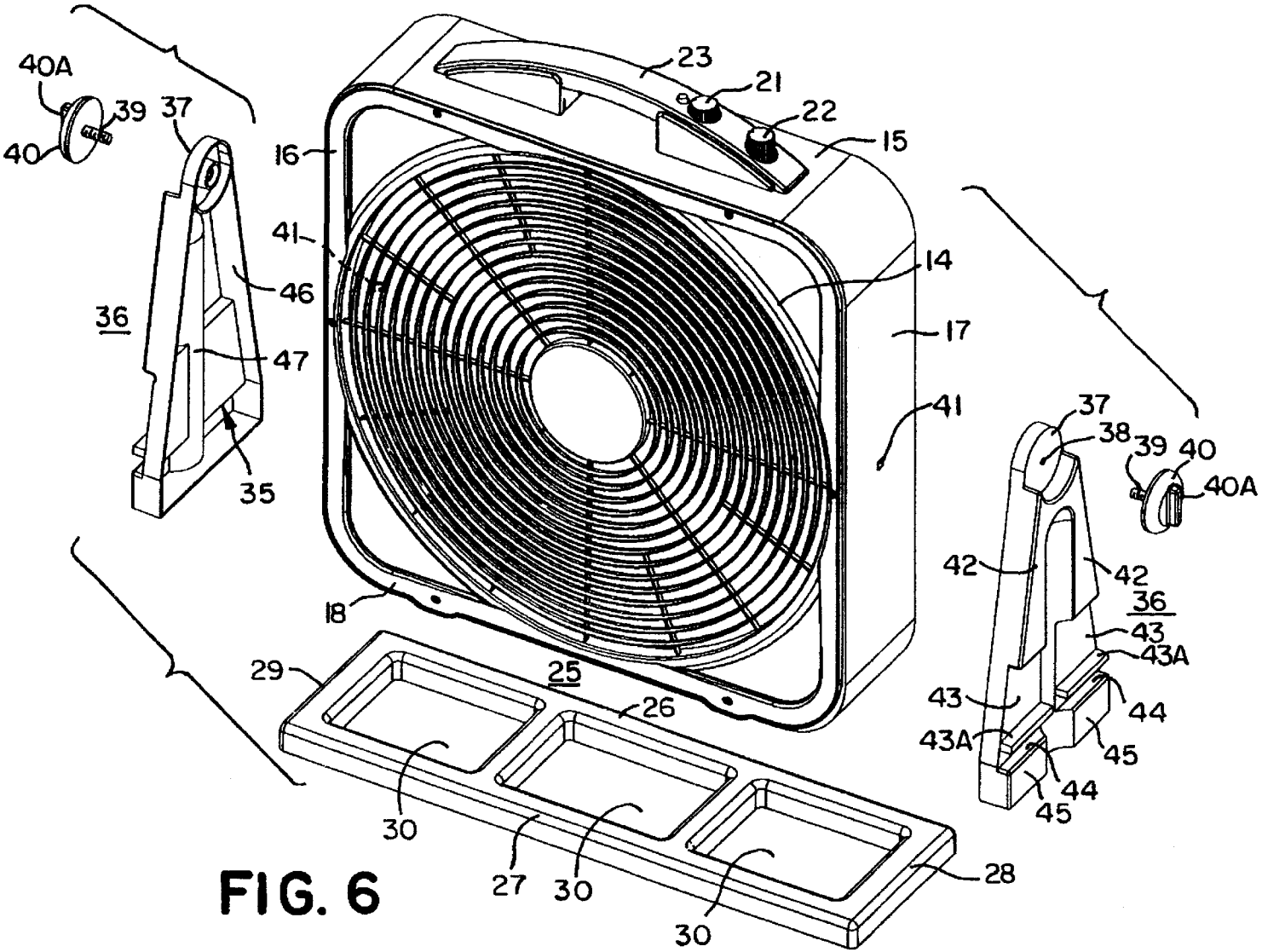
FIG. 6 is an exploded perspective view of the fan of FIG. 1.

It should, of course, be understood that the description and drawings herein are merely illustrative and that various modifications and changes can be made in the structures disclosed without departing from the spirit of the invention.

Like numerals refer to like parts throughout the several views.

DESCRIPTION OF THE PREFERRED EMBODIMENT

When referring to the preferred embodiment, certain terminology will be utilized for the sake of clarity. Use of such terminology is intended to encompass not only the described embodiment, but also technical equivalents which operate and function in substantially the same way to bring about the same result.

Referring now more particularly to FIGS. 1–6 of the drawings, the combination floor and window box fan 10 includes an outer housing 11 of square configuration, with a circular front grill 12, and a rear grill 14, attached to the housing in well known manner.

The housing 11 can be formed of metal or plastic, and has a top wall 15, left side wall 16, right side wall 17 and bottom wall 18.

A fan motor (not shown) is mounted to the rear grill 14 in conventional well known manner, and has a fan hub (not shown) with a plurality of blades 20 thereon.

The housing top wall 15 has an on/off switch 21, and a variable thermostat switch 22, which are connected to the fan motor (not shown) by wires (not shown) in well known manner.

The housing top wall 15 is also provided with a carrying handle 23.

The fan 10 includes a base plate 25 which is of rectangular configuration, with front and rear walls 26 and 27, and end walls 28 and 29. The base plate 25 has three openings 30 therein, and can rest on a floor or other supporting surface (not shown) as desired.

The end walls 28 and 29 are detachably captured in recesses 35 in brackets 36.

The brackets 36 are of triangular configuration, with bosses 37 which have openings 38 through which threaded extensions 39 of knobs 40 extend in assembled condition into captive nuts 41 in side walls 16 and 17 of housing 11. The knobs 40 each have a raised rib 40A for engagement for rotating the knobs 40. The brackets 36 each have raised panels 42 extending downwardly from boss 37, with a central slot 38 therebetween.

The panels 42 terminate at recessed panels 43, which terminate at walls 44 of raised panels 45.

The panels 43 each have a transverse rib 43A to be described.

Panels 43 are intended to engage a window sash or window sill for hanging the fan therefrom to be described.

The bracket 36 has a perimeter rim 46 and central reinforcing rib 47.

Figure 7:
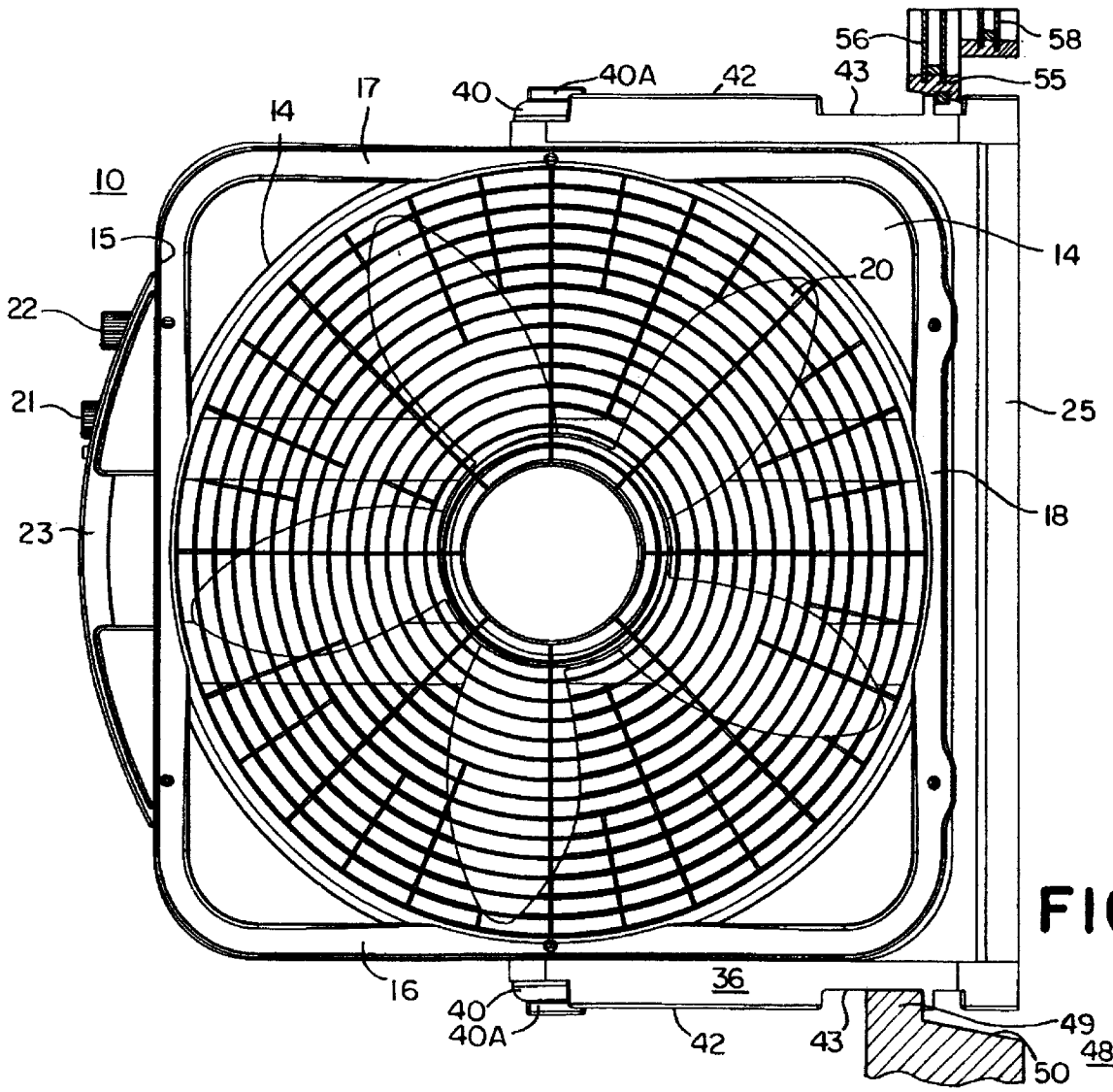
FIG. 7 is a front elevational view of the fan of FIG. 1 as installed in a typical window of wood construction.

Referring additionally to FIG. 7, a typical wooden window construction in fragmentary form is illustrated, which has a fan 10 hanging therefrom, which window includes a window sill 48 with an upstanding rib 49 and sloped surface 50.

Panels 43 of a bracket 36 on side wall 16 of fan 10 are engaged by the rib 49.

Panels 43 of bracket 36 on side wall 17 of fan 10 have the rib 43A engaged with the bottom mullion 55 of a lower window sash 56, shown in an up position, which engages walls 44, and with rib 49 of the sill 48 retains the fan brackets 36 in the window opening, which locates the fan motor (not shown), fan hub (not shown), fan blades 20 and wiring (not shown) inside the room away from the elements. A portion of an upper window sash 58 is also illustrated adjacent to window sash 56.

The window sash 56 can be restrained in its up position by wedging in well known manner, or by the use of L-shaped brackets (not shown) attached thereto, which are typically used when installing window air conditioners (not shown).

Figure 8:
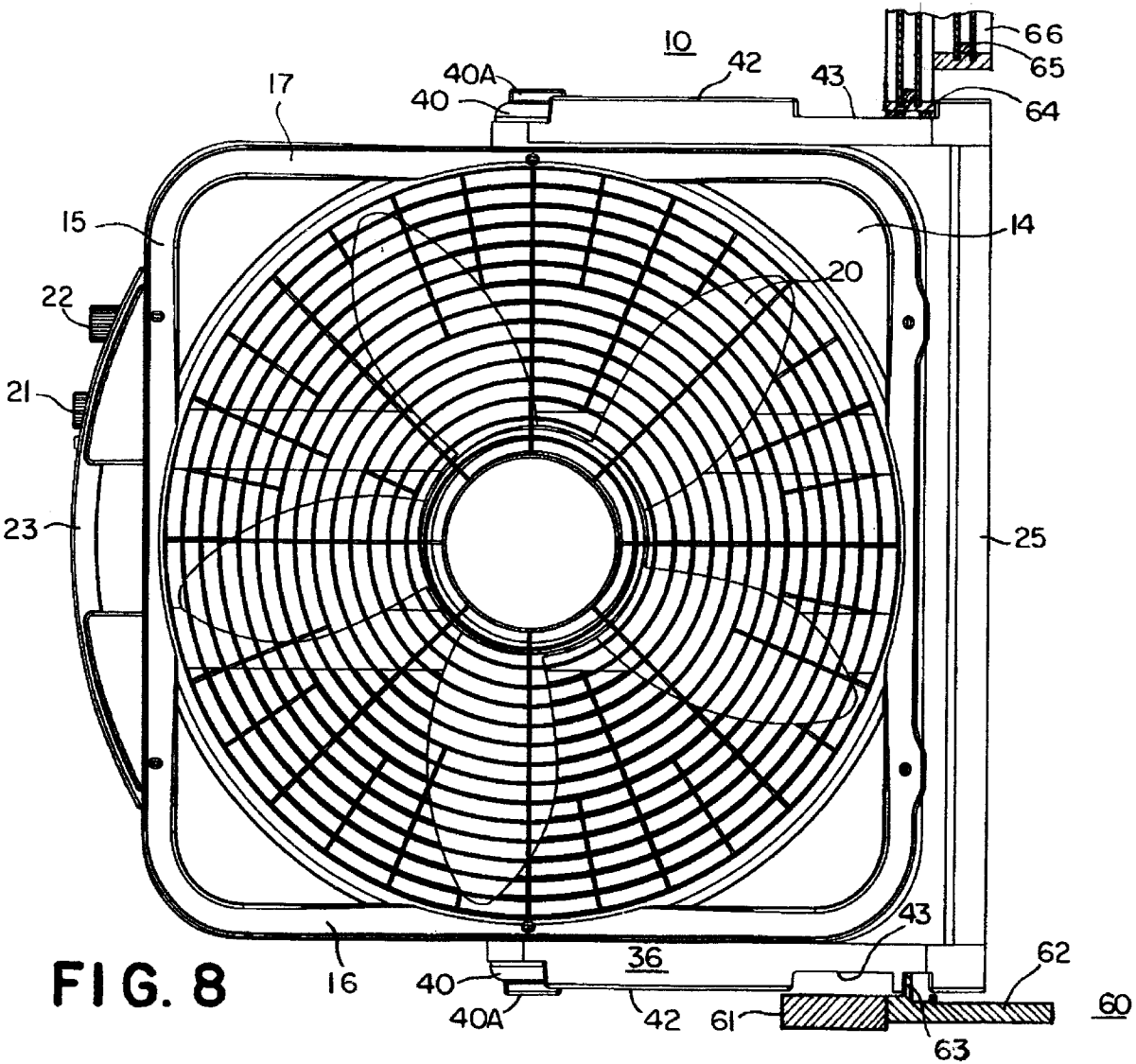
FIG. 8 is a view similar to FIG. 7 but illustrating the fan installed in a typical window of vinyl construction.

Referring now to FIG. 8 a typical vinyl window construction is therein illustrated, with a fan 10 hanging therefrom, the window includes a window sill 60 with a flat panel 61 which can contact panels 42 of a bracket 36. The sill 60 has a panel 62 with a rib 63 which engages panels 43 of bracket 36, which is fastened to side wall 17 of fan 10. Another bracket 36 is attached to side wall 16 of fan 10, which has traverse ribs 43A of panels 43 engaged with slot 64 in lower sash 65. Lower sash 65 is in the up position, and is also engaged with walls 44 to retain the fan brackets 36 in the window, locating the fan motor (not shown) fan hub (not shown) fan blades 20 and wiring (not shown) inside the room away from the elements.

Figure 9:
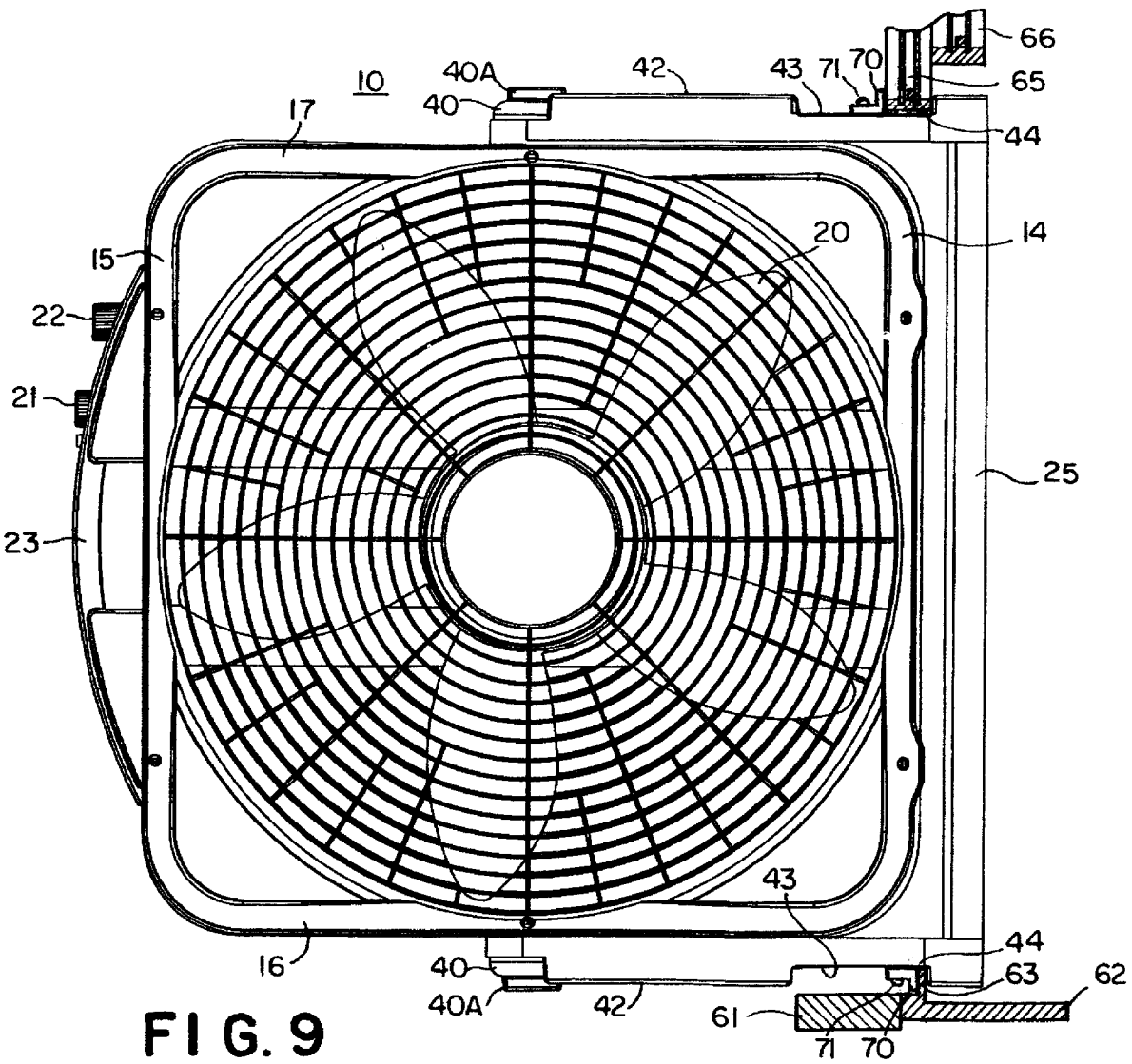
FIG. 9 is a view similar to FIG. 8 showing an optional clamping structure used with the fan.

An upper sash 66 is also provided adjacent sash 65. Referring to FIG. 9 a vinyl window similar to FIG. 8 is illustrated with a fan 10 hanging therefrom. The side wall 17 has an L-shaped bracket 70 attached thereto by a screw 71, which bracket urges lower sash 65 against walls 44, with ribs 43A in slot 64 in lower sash 65.

The side wall 16 of housing 11 has another L-shaped bracket 70 attached thereto by screw 71, and the bracket is also engaged with rib 63 from sill 60 clamping the rib 63 between it and walls 44 of panels 45.

It will thus be seen that a combination floor and window box fan has been described with which the objects of the invention are achieved.

I claim:

1. A combination floor and window box fan which may sit on a supporting surface or be hung from a window, which window has a window sill and vertically movable upper and lower window sash, the improvement which comprises:

a housing having a front grill and a rear grill;

a fan motor mounted to said rear grill;

a fan hub connected to said motor;

a plurality of fan blades connected to said hub;

said housing having a top wall, a bottom wall and side walls;

brackets rotatably mounted by mounting means to said side walls of said housing;

said brackets being of triangular shape and having front and back sides; said back side having recesses at the ends thereof, and said front side having raised panels and recessed panels, said recessed panels terminating at meeting walls of said raised panels;

a base plate having end walls which being engaged in said recesses; and said recessed panels and said meeting walls being engagable by said window sill and said lower window sash for retaining said fan therebetween.

2. A combination floor and window box fan as defined in claim 1 in which said mounting means includes a boss on one end of each of said brackets opposite said raised and recessed panels;

an opening in said boss;

captive nuts in said side walls of said housing;

knobs having threaded extensions which extend through said boss openings and into said captive nuts in said side walls to retain said brackets thereon, while permitting rotation of said housing between said brackets.

3. A combination floor and window box fan as defined in claim 1 in which:

said raised panels of said one of said brackets is engaged with said window sill.

4. A combination floor and window box fan as defined in claim 1 in which:

an L-shaped bracket is detachably engaged with said upper sash and one of said side walls, and another L-shaped bracket is detachably engaged with said window sill and the other of said side walls, whereby said fan is retained in said window.

5. A combination floor and window box fan as defined in claim 4 in which said window sill has an upstanding rib, and said rib is engaged by said other L-shaped bracket and said meeting walls.

6. A combination floor and window box fan as defined in claim 1 in which said lower window sash has a slot therein, and said recessed panels of said brackets have transverse ribs which engage said slot in said lower window sash.

7. A combination floor and window box fan as defined in claim 1 in which said housing top wall has a carrying handle thereon.

* * * * *